United States Patent [19]

Fleming, Jr.

[11] Patent Number: 4,931,000

[45] Date of Patent: Jun. 5, 1990

[54] DOUBLE ACTING DIAPHRAGM AIR PUMP

[75] Inventor: William T. Fleming, Jr., Glen Gardner, N.J.

[73] Assignee: Gilian Instrument Corp., Wayne, N.J.

[21] Appl. No.: 318,019

[22] Filed: Mar. 2, 1989

[51] Int. Cl.[5] ..... F04B 43/02

[52] U.S. Cl. ..... 417/534; 417/413

[58] Field of Search ..... 417/534, 413

[56] References Cited

U.S. PATENT DOCUMENTS 3,801,232 4/1974 Kilayko ..... 417/413
4,432,248 2/1984 Lalin ..... 73/863.03

FOREIGN PATENT DOCUMENTS 2420671 11/1979 France ..... 417/534
0120405 9/1979 Japan ..... 417/534

*Primary Examiner*—Donald E. Stout

*Assistant Examiner*—David W. Scheuermann

*Attorney, Agent, or Firm*—E. Lieberstein

[57] ABSTRACT

An electrically driven double-acting diaphragm air pump having a diaphragm-driven system including an eccentric for the motor shaft, a freely movable yoke having a solid framework solely supported by the diaphragm system with one end connected to a first diaphragm assembly, and at an opposite end to a second diaphragm assembly, and with the yoke having a large central opening. The eccentric is coupled directly to the solid framework through a yoke driver. The yoke driver is rotatably connected to the solid framework at one end of the framework adjacent to the first diaphragm assembly, and is coupled to the eccentric through ball bearings, with the opposite end of the yoke driver suspended for free movement within the large central opening of the solid yoke framework.

5 Claims, 4 Drawing Sheets

DOUBLE ACTING DIAPHRAGM AIR PUMP

FIELD OF THE INVENTION

This invention relates to a compact, electrically driven double-acting diaphragm air pump of high efficiency and low operating noise.

BACKGROUND OF THE INVENTION

High efficiency, high performance computer tape drives are driven by tape transport systems which utilize air bearings designed to suspend the tape on a cushion of air as the tape passes over the read/write head(s). By significantly reducing tape friction and the associated noise and vibration, much higher data density and transfer rates are possible. The absolute performance and reliability of the system depend upon a supply of air to the bearings which is clean, and has minimal flow pulsations. The pulsation amplitude and frequency of the air supply must be within a predetermined narrow range determined by the natural frequencies of the computer tape drive system so as not to excite a resonant condition in the tape drive system. The air source must also be extremely quiet, high in efficiency and generate little heat.

Although conventional double-acting diaphragm air pumps are known to provide a source of clean air with minimal flow pulsations, they are inherently noisy and, if continuously operated, have a short lifetime. In the conventional double-acting diaphragm pump, the motor drives an eccentric which, in turn, drives one or more yoke members for converting rotational motion into rectilinear motion. The yoke member(s) flex the diaphragm assemblies which operate the valves. The drive assembly between the eccentric and each diaphragm is conventionally designed to operate through a separate yoke drive or by using a common yoke arranged in an oval slot, known to those skilled in the art as a Scotch yoke. In reference to the former, unless the yokes are extremely long in length, the use of individual yokes will impart a highly non-linear motion to the diaphragm assembly. This is detrimental to long life and not very practical, particularly for the subject application in which the pump has to be compact and as small in size as possible. A Scotch yoke arrangement is inherently noisy because the drive bearing must alternately impact opposite sides of the oval slot.

The non-diaphragm pump is unsatisfactory because it requires a lubricant which can contaminate the supply of air, is generally noisy and of much lower efficiency compared to the diaphragm pump.

SUMMARY OF THE INVENTION

The double-acting pump assembly of the present invention comprises a compact body having walls forming a substantially enclosed volume, an air intake port, an exit port, a set of valve means mounted on opposite sides of said substantially enclosed volume, a diaphragm assembly for each set of valve means, a plenum chamber formed between each set of valve means and each diaphragm assembly, a yoke having a solid framework surrounding a large, central opening with one end of the framework connected to one diaphragm assembly, and an opposite end of the framework connected to the other diaphragm assembly; a motor mounted to said pump body and having a rotatable shaft extending into said substantially enclosed volume; an eccentric connected to said motor shaft for common rotation therewith; yoke driver means rotatably connected at one end to said solid yoke framework adjacent one of said diaphragm assemblies, and having an opposite end freely suspended in said central opening; and ball bearing means for coupling said yoke driver means to said eccentric within said central opening of said solid yoke.

DETAILED DESCRIPTION OF THE INVENTION

Figure 1:
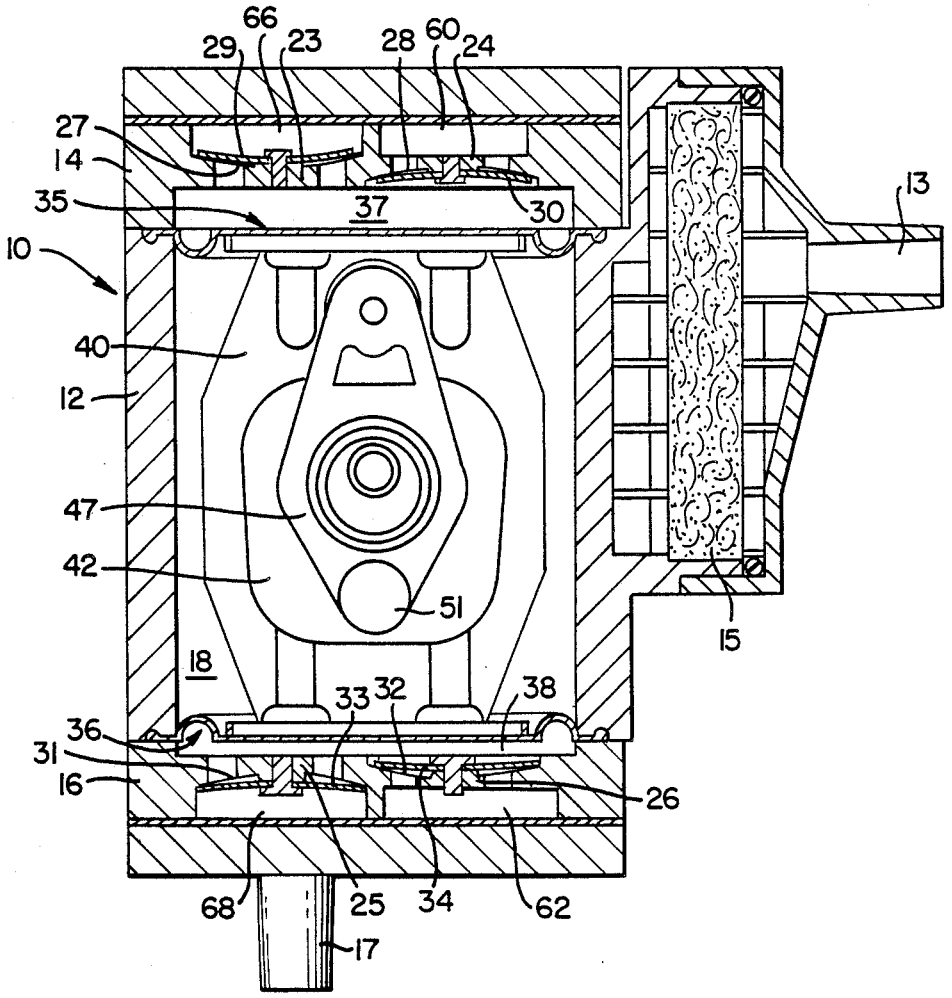
FIG. 1 is a view in longitudinal section, partly diagrammatic, of the pump assembly of the present invention.
Figure 2:
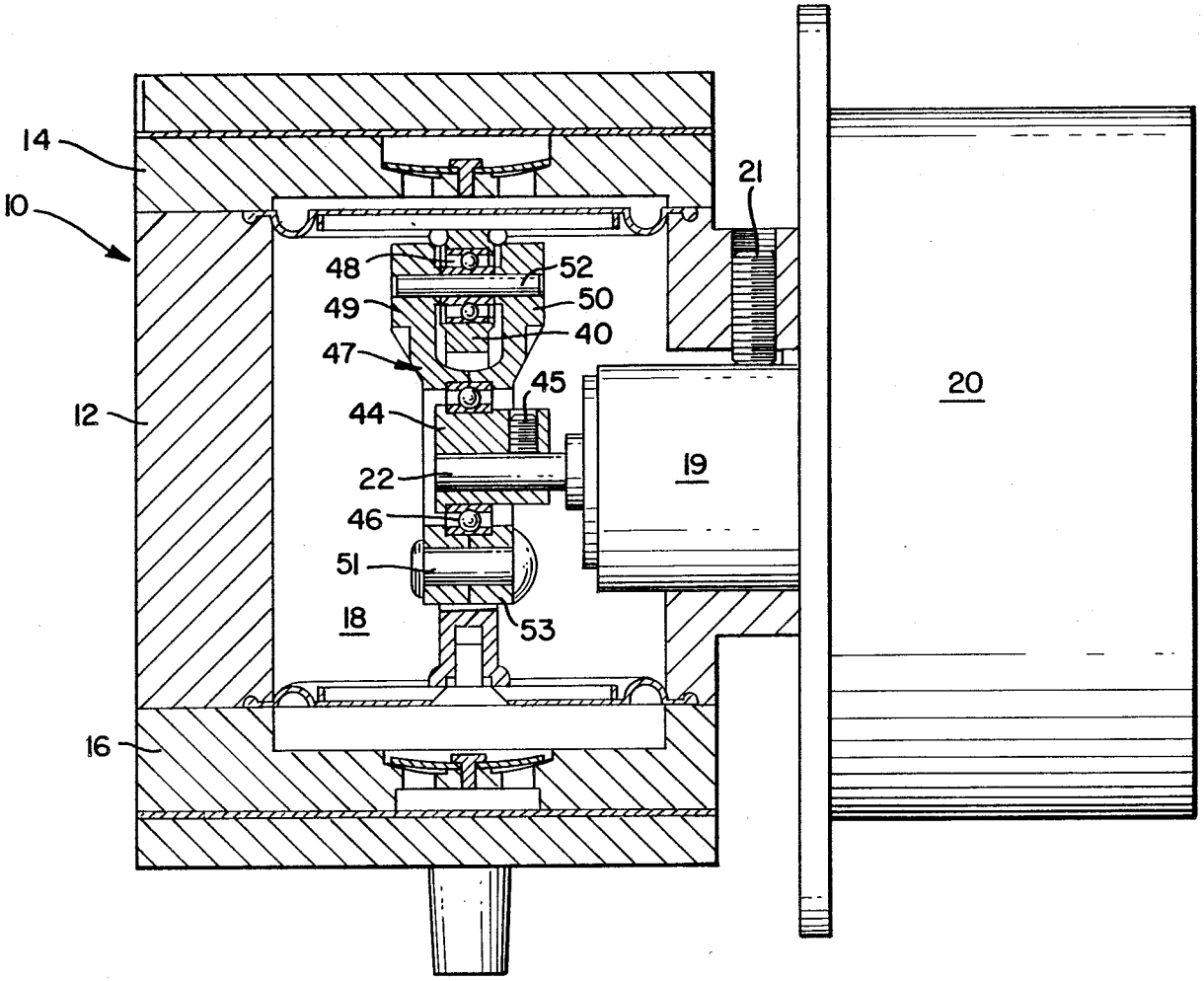
FIG. 2 is a side view in cross section, partly diagrammatic of the pump assembly of FIG. 1.

The pump assembly of the present invention, as shown in FIGS. 1 and 2, inclusive, comprises a pump body (10) with an upright wall (12), an upper valve plate (14), and a lower valve plate (16) which forms a hollow, substantially enclosed volume (18). The pump body (10) includes an air inlet port (13), a filter (15), and a discharge or exit port (17). The filter (15) filters the air being drawn into the pump. An electric motor (19), preferably a DC motor, is supported in a housing (20), with the motor (19) attached to the pump body (10) by means of a set screw (21). The DC motor (19) has a rotatable shaft (22) extending into the substantially enclosed volume (18) of the pump body (10).

The upper valve plate (14) includes a set of valve (23) and (24) which operate inversely during each half cycle of motor rotation in conjunction with the operation of a similar set of valves (25) and (26) in the lower valve plate (16) to provide what is known to the art as a "double-acting" pump for each cycle of motor rotation. The valves (23) and (24) in the upper valve plate (14) are preferably composed of concave dish-shaped valve seats (27) and (28) with flexible valve disks (29) and (30), respectively, of conforming shape. Similarly, the valves (25) and (26) in the lower valve plate (16) are composed of concave dish-shaped valve seats (31) and (32) with flexible valve disks (33) and (34), respectively, of conforming shape.

One diaphragm assembly (35) is mounted between the upper plate (14) and the upright wall (12), and another diaphragm assembly (36) is mounted between the lower valve plate (16) and the upright wall (12). A plenum chamber (37) and (38) is formed between each diaphragm assembly (35) and (36) and the upper and lower valve plates (14) and (16), respectively. The diaphragm assemblies (35) and (36) are connected in common through a solid yoke (40). The solid yoke (40) has a large central opening (42).

The shaft (22) of the DC motor (19) is eccentrically mounted to a body (44) through a set screw (45). The eccentricallY mounted body (44) is coupled through ball bearings (46) to a yoke driver (47) within the central opening (42) of the solid yoke member (40). The yoke driver (47) is, in turn, rotatably coupled through ball bearings (48) to the solid yoke member (40) adjacent the diaphragm assembly (35). The yoke driver (47) is preferably formed from two plates (49) and (50) connected at one end (53) through a rivet (51). The end (53) of the yoke driver (47) is held freely suspended in the large central opening (42) of the solid yoke member (40). The plates (49) and (50) are connected at their opposite end to a connecting pin (52) mounted in ball bearings (48) which, in turn, rotatably connects the plates (49) and (50) to the solid yoke member (40). The yoke driver (47) thus forms a "wish-bone" like geometry which permits it to freely swing in a pendulum-like fashion within the large opening (42) of the yoke member (40), while being rotatably connected to the solid yoke member (40) through the ball bearings (48). Since the outer race of the drive ball bearings (46) is fixed within the yoke driver (47) and the yoke driver (47) is mounted through ball bearings (48) to the solid yoke member (40), the entire diaphragm drive system is virtually silent.

In operation, as the motor shaft (22) rotates, the body (44), which is eccentricallY mounted to the motor shaft, causes the solid yoke (40) to move in a reciprocating rectilinear motion in response to the movement of the yoke driver (47). The yoke driver (47) swings in a somewhat pendulum-like fashion within the central opening (42).

Figure 3:
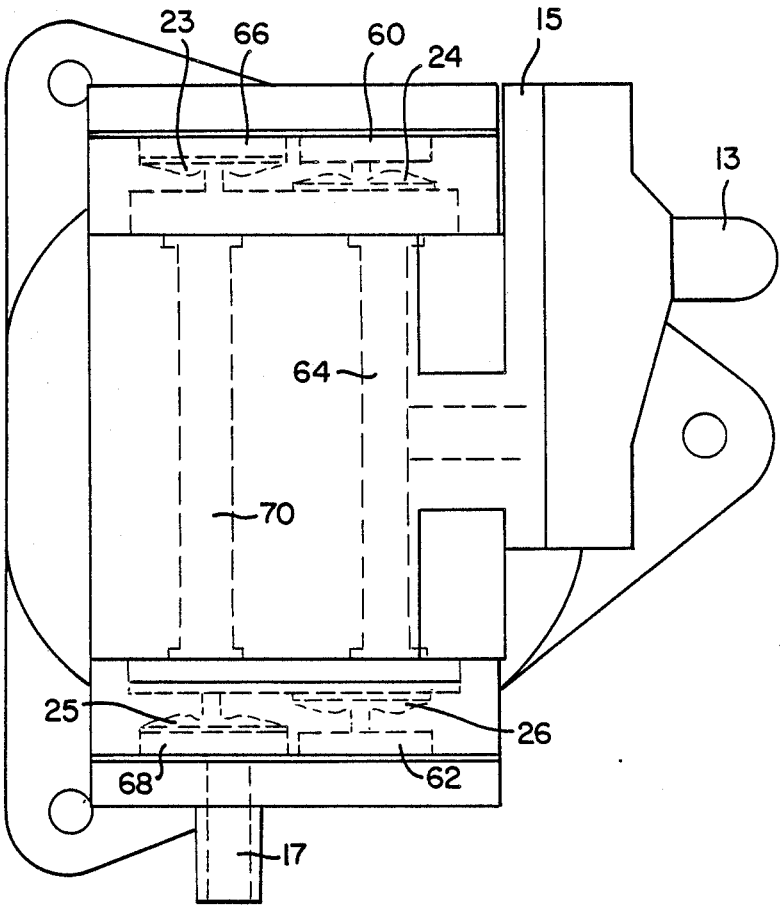
FIG. 3 is a diagrammatic view of the piping arrangement between the valves and the inlet and outlet ports of the pump.
Figure 4:
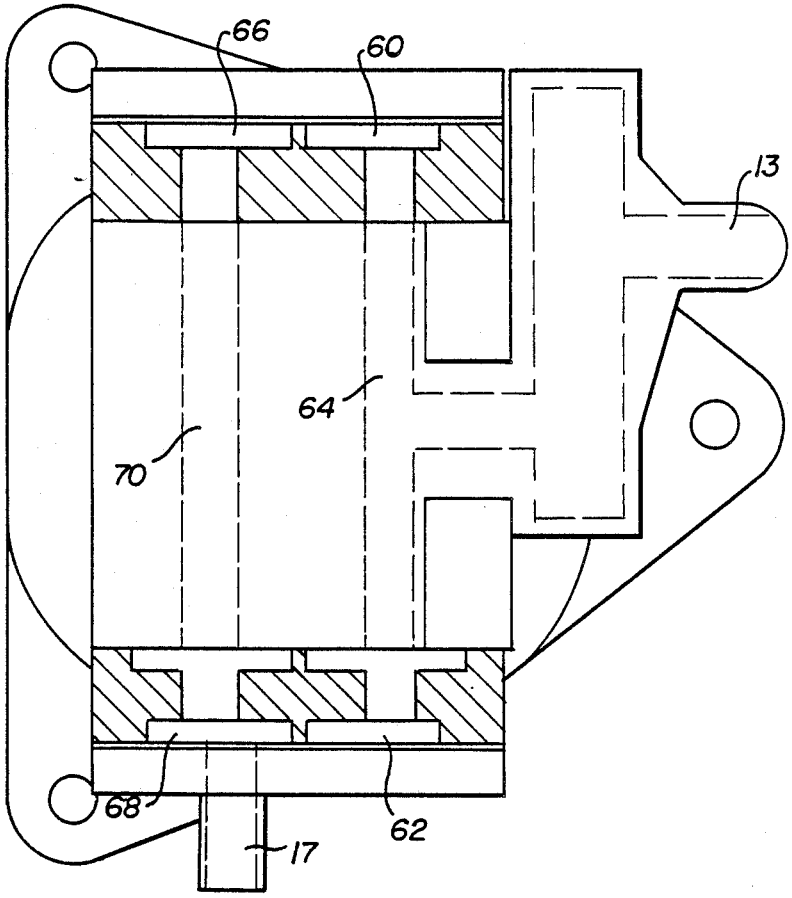
FIG. 4 is another diagrammatic view, similar to FIG. 3, showing the pump in a different orientation to illustrate the connections between the channels and the inlet and exit ports, respectively.

The inlet valve (24) in the upper valve plate (14) is the mirror image of the inlet valve (26) in the lower valve plate (16). Likewise the outlet valve (23) in the upper valve plate (14) is the mirror image of the outlet valve (25) in the lower valve plate (16). The inlet port (60) in the upper valve plate is connected in common to the inlet port (62) in the lower valve plate (16) through channel (64), as shown in FIG. 3, which communicates with the inlet port (13) through the filter assembly (15). Likewise the outlet port (66) is connected in common to the outlet port (68) through the channel (70) which communicates with the exit port (17).

As the solid Yoke (40) is moved upwardly and downwardly, it flexes the diaphragm assemblies (35) and (36) upwardly and downwardly in opposite phase to pump air under pressure through the exit port (17). The operation of the double-acting diaphragm air pump of the present invention, other than for the diaphragm drive system, is conventional. A typical prior art double-acting pump is shown and described in U.S. Pat. No. 4,432,248, the disclosure of which is herein incorporated by reference.

I claim:

1. A double-acting air pump assembly comprising a compact body having walls forming a hollow, substantially enclosed volume, an air intake port, an exit port, a set of valve means mounted on opposite sides of said substantially enclosed volume, a diaphragm assembly for each set of valve means, a plenum chamber formed between each set of valve means and each diaphragm assembly, a yoke supported only by said diaphragm assemblies, and having a solid freely movable framework surrounding a central opening in said body with one end of the framework connected to one diaphragm assembly, and an opposite end of the framework connected to the other diaphragm assembly to provide for rectilinear motion in common with the movement of each diaphragm assembly; a motor mounted upon said pump body and having a rotatable shaft extending into said substantially enclosed volume; an eccentric connected to said motor shaft for common rotation therewith; yoke driver means connected with a single rotatable connecting point at one end to said solid yoke framework adjacent one of said diaphragm assemblies, and having an opposite end freely suspended in said central opening; and ball bearing means for coupling said yoke driver means to said eccentric within said central opening of said solid yoke.

2. A double-acting air pump assembly, as defined in claim 1, wherein said means for rotatably connecting one end of said yoke driver to said solid yoke comprises second ball bearing means.

3. A double-acting air pump assembly, as defined in claim 2, wherein said yoke driver comprises a pair of plates with means connecting one end of each plate together to said second ball bearing means.

4. A double-acting air pump, as defined in claim 3, wherein said connecting means is a pin.

5. A double-acting air pump, as defined in claim 3, further comprising means for connecting the opposite end of each plate together within said large, central opening of said solid yoke.

* * * * *